United States Patent [19]

Hensley

[11] 4,290,554

[45] Sep. 22, 1981

[54] TEMPERATURE ACTUATED FOUNDATION VENTILATOR

[76] Inventor: Robert C. Hensley, Rte. 7, Box 551, Lincolnton, N.C. 28092

[21] Appl. No.: 8,529

[22] Filed: Feb. 1, 1979

[51] Int. Cl.[3] ..... F24F 7/00

[52] U.S. Cl. ..... 236/49; 98/37; 98/29; 98/40 VT; 236/101 D

[58] Field of Search ..... 98/40 VT, 40 R, 41 R, 98/29, 37, 101; 236/48, 49, 101 D; 251/337; 267/166; 160/38 R; 261/39 B

[56] References Cited

U.S. PATENT DOCUMENTS

| | | | |
|---|---|---|---|
| 1,144,856 | 6/1915 | Lenhoff | 160/368 R |
| 1,783,574 | 12/1930 | Lawler | 98/40 VT |
| 2,385,096 | 9/1945 | McCollum | 236/101 D |
| 2,681,215 | 6/1954 | Olson | 261/39 B |
| 3,436,016 | 4/1969 | Edwards | 98/40 R |
| 3,528,606 | 9/1970 | Witten | 98/29 |

*Primary Examiner*—Albert J. Makay

*Assistant Examiner*—Henry Bennett

*Attorney, Agent, or Firm*—Clifton T. Hunt, Jr.

[57] ABSTRACT

A temperature actuated foundation ventilator comprises a rectangular housing with top, bottom and side walls, air permeable screens on the front and rear walls, a plurality of louvers extending between the side walls and a bi-metallic element for actuating the louvers into closed position in cold weather and into open position in hot weather. The bi-metallic element is exposed to the ambient temperature exteriorly of the housing and at the same time enclosed within a protective cover which includes means for positively supporting the bi-metallic element in operative position. Movement of the bi-metallic element responsive to changes in temperature causes corresponding movement of a control link connected to the bi-metallic element exteriorly of the housing and extending into the housing and into pivotal engagement with each of a plurality of louvers journaled in opposed side walls of the housing.

2 Claims, 6 Drawing Figures

TEMPERATURE ACTUATED FOUNDATION VENTILATOR

BACKGROUND OF THE INVENTION

Foundation ventilators are advantageous in providing ventilation to crawl spaces beneath houses and elsewhere to circulate fresh air into enclosed areas and prevent rot and decay resulting from dampness. Such ventilators are generally provided with one or more louvers so that the ventilator may be closed in cold weather to prevent undesirable drafts and may be opened in warm weather to circulate fresh air within the enclosed area.

The louvers in such ventilators are generally manually manipulated to open or close the ventilator as desired but there have been several devices known in the prior art for automaticallly opening and closing the ventilators in response to changes in the temperature. Temperature controlled ventilators are shown in U.S. Pat. No. 1,358,193 issued Nov. 9, 1920 to Weston M. Fulton, U.S. Pat. No. 2,975,975 issued Mar. 21, 1961 to Erwin L. Weber, U.S. Pat. No. 3,169,999 issued Jan. 19, 1965 to Frank P. Noll, U.S. Pat. No. 3,368,756 and U.S. Pat. No. 3,436,016 issued in 1968 and 1969, respectively, to Ralph S. Edwards, and U.S. Pat. No. 3,528,606 issued Sept. 15, 1970 to Alvin E. Witten.

The patents to Webber, Noll, Edwards and Witten are all concerned with ventilators particularly intended for use in the foundations of buildings, as in applicant's ventilator. Foundation ventilators are installed in the masonry or brick work of a building foundation and difficulty has been experienced with some of the prior art temperature responsive ventilators because the wet mortar falls on working parts of the ventilator thereby rendering it inoperable for its intended function. Difficulty has also been experienced in certain of the prior art temperature responsive foundation ventilators in maintaining the temperature rsponsive or bi-metallic element in operative relation to the actuating mechanism for the louvers of the ventilator. Some of the prior art temperature responsive foundation ventilators are rendered inoperative by foreign matter and insects becoming entangled in the bi-metallic element and/or the actuating mechanism for the louvers. It is desirable that a ventilator used in the foundation of a building occupy as little of the air space as possible within the opening provided for the ventilator in the foundation wall. In general this type of ventilator comprises a frame, a screen, louvers, and actuating mechanism to open and close the ventilators, and an opening of about 8×16 inches (20×40 centimeters) or 128 square inches (800 centimeters) is often provided in a foundation wall for a ventilator. It is preferred that the ventilator components occupy only about one-half the open space in the foundation, but the components of at least one prior art ventilator occupy more air space than needed resulting in less ventilation when the louvers are opened.

SUMMARY OF THE INVENTION

It is an object of this invention to provide a temperature responsive foundation ventilator with a minimum of working parts arranged in such a manner as to occupy a minimum of air space consistent with efficient and reliable operation.

More specifically, the ventilator of the present invention includes means for protecting the operative parts from wet mortar during installation of a ventilator in a foundation, includes means for exposing the temperature responsive element to the ambient temperature, includes means for maintaining the temperature responsive element in operative relation to the actuating mechanism for the louvers of the ventilator, includes means for protecting the operative parts of the ventilator from insects and foreign matter, and arranges these elements in a compact manner to occupy a minimum of air space.

DETAILED DESCRIPTION OF THE INVENTION

Figure 1:
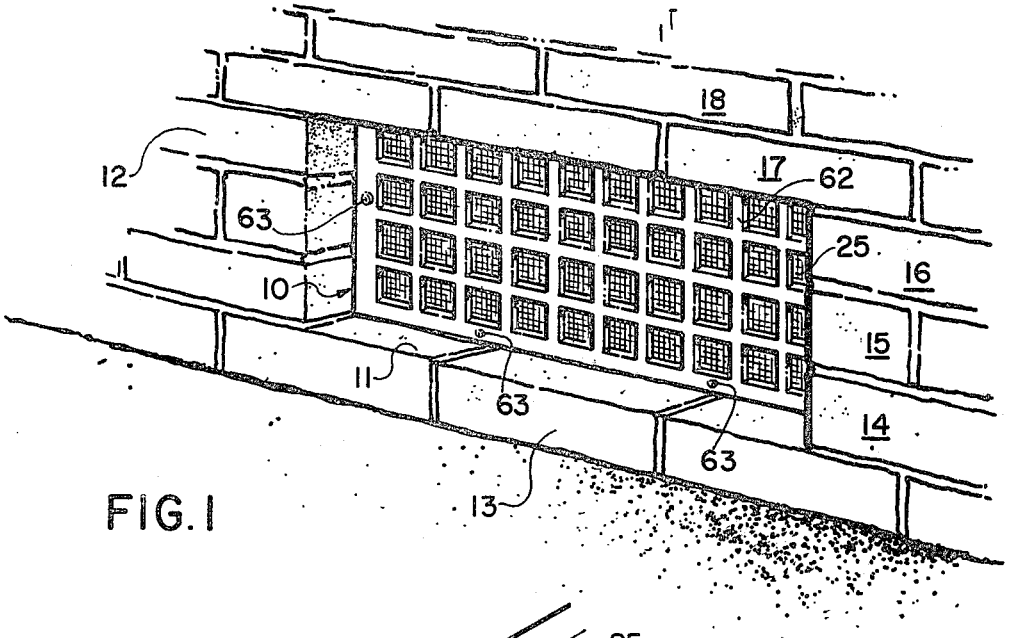
FIG. 1 is a perspective view, with parts broken away, showing a ventilator installed in the foundation of a building.

Referring to FIG. 1, a foundation ventilator broadly indicated at 10 is illustrated as being operatively positioned within an opening 11 of a foundation 12 of a building, not shown.

The ventilator 10 is manufactured as a separate item and delivered to the building site to be installed in the foundation as it is being laid. Referring to FIG. 1, the complete ventilator 10 was delivered to a brick mason working on a course of freshly laid brick and/or cinderblock 13 and built successive courses of brick and/or cinderblock 14, 15 and 16 about the sides of ventilator 10. Succeeding courses of brick and/or cinderblock 17, 18, etc. were laid on top of the ventilator 10.

Figure 6:
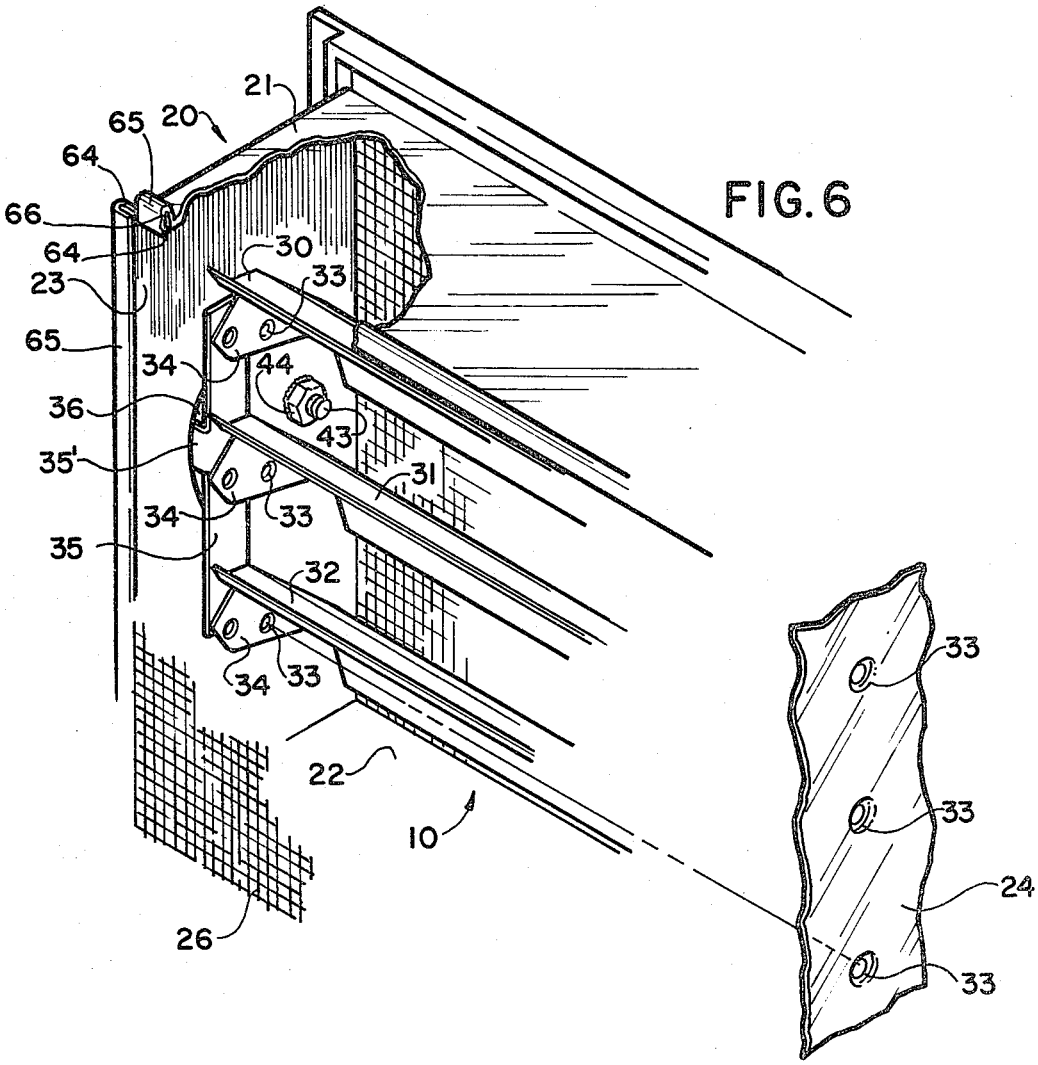
FIG. 6 is a perspective view, with parts broken away, looking at the inside of the ventilator and illustrating the connection of the actuating mechanism with the louvers.

The ventilator 10 comprises a rectangular frame broadly indicated at 20 and comprising top and bottom walls 21 and 22 and side walls 23 and 24. The front and rear of the frame are open but are covered by screens 25 and 26, respectively, in the assembled ventilator. Louvers 30, 31 and 32 extend between side walls 23 and 24 as by rivets 33 journaled in respective side walls and in flanges 34 extending in perpendicular relation to the ends of louvers 30, 31 and 32 (FIG. 6). The flanges 34 are each pivotally connected to an actuator bar 35 extending vertically in spaced relation to the inner surface of side wall 23. Side wall 23 has an arcuately shaped cut out 35 in its medial portion through which extends a perpendicular extension 35' of actuator bar 35.

A bi-metallic element in the form of a spring 40 having an inner end 41 and an outer end 42 is supported against the outer surface of side wall 23 by having inner end 41 extend through a bifurcated stud 43 extending outwardly through side wall 23 and threaded in a nut 44 welded to the inner surface of side wall 23. The outer end 42 of bi-metallic element 40 extends loosely through a slot 45 in the extension 35' of actuator bar 35.

The bi-metallic element 40 is responsive to changes in temperature to contract in cold temperature and expand or unwind in warm temperature. The movement of bi-metallic element 40 occasioned by changes in temperature is imparted to extension 35' of actuator bar 35 to impart corresponding movement to louvers 30, 31 and 32 so that the louvers close in cold weather and open in warm weather. The bi-metallic element 40 may be adjusted for movement responsive to predetermined temperature ranges by rotation of the bifurcated stud 43 relative to the supporting nut 44.

Figure 2:
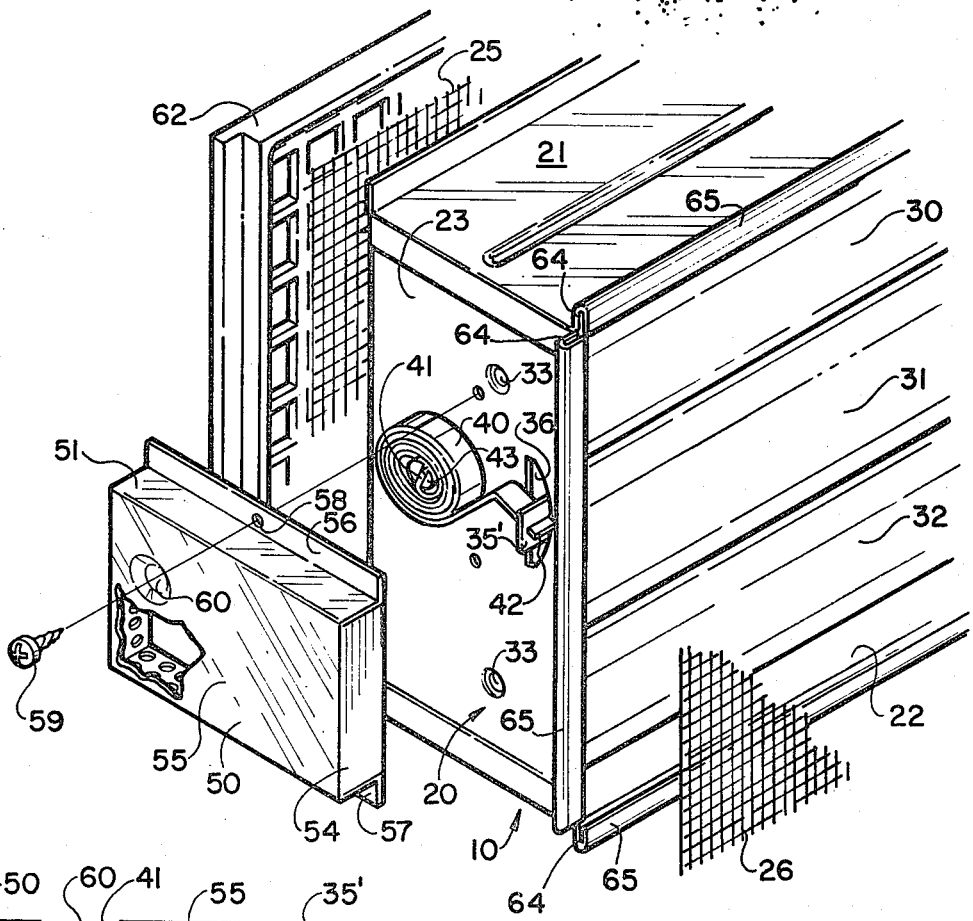
FIG. 2 is an exploded perspective view, with parts broken away, illustrating the connection of the bi-metallic element with the actuating mechanism and the assembly of the screen, grill, and protective cover on the frame.
Figure 5:
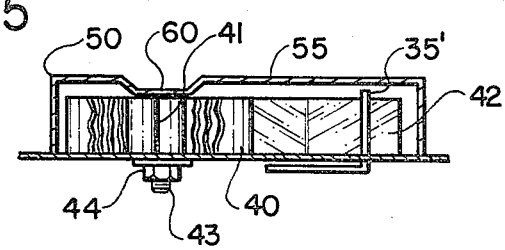
FIG. 5 is a vertical sectional view taken substantially along the line 5—5 in FIG. 4.
Figure 3:
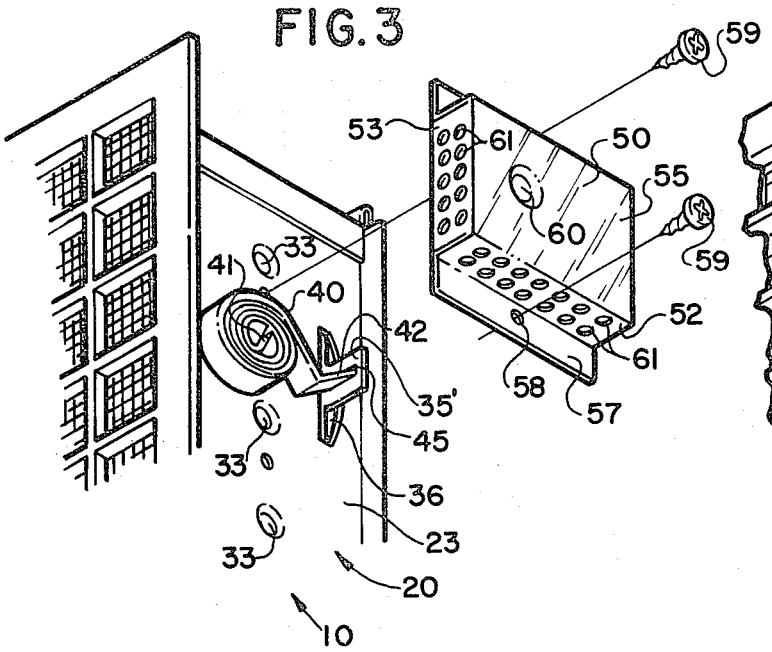
FIG. 3 is a perspective view, with parts broken away, showing the bottom and front wall of the protective cover and further illustrating its assembly to the frame over the bi-metallic element and its connection with the linkage.
Figure 4:
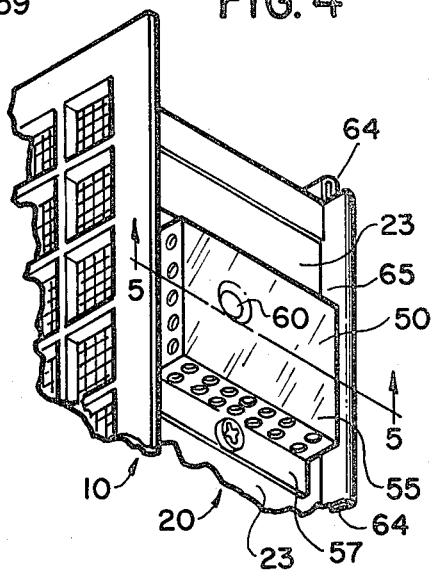
FIG. 4 is a perspective view similar to FIG. 3, but showing the protective plate operatively mounted on the frame.

A protective cover 50 having a top wall 51, bottom wall 52, front wall 53, rear wall 54 and side wall 55 covers the bi-metallic element 40 and its juncture with the extension 35' which extends through opening 36 from actuating bar 35. Out-turned flanges 56 and 57 extend from top wall 51 and bottom wall 52 and have openings 58 to receive screws 59 connecting cover 50 to side wall 23 of the ventilator as best seen in FIGS. 2, 3 and 4. The side wall 55 has a dimpled portion 60 pressed inwardly to register with the bifurcated stud 43 and the inner end 41 of bi-metallic element 40 in assembled relation as most clearly seen in FIG. 5. The inwardly extending dimpled portion 60 effectively functions to retain the inner end 41 of bi-metallic element 40 within the bifurcated stud 43 when in use.

To adjust the bi-metallic element 40 it is necessary to remove the screws 59 and the protective cover to gain access to the bifurcated stud 43. The stud 43 may be rotated by inserting a screwdriver into its bifurcated end and rotating the stud 43 relative to its retaining nut 44. Rotation of the inner end 41 and stud 43 in one direction will move the louvers to the closed position of FIG. 2 and rotation of the inner end 41 and stud 43 in the other direction will move the louvers to the open position of FIG. 6.

The front wall 53 and bottom wall 52 have a plurality of perforations 61 for the purpose of exposing the bi-metallic element 40 to the ambient temperature so it may be fully responsive to changes in temperature to actuate the louvers in the manner desired as explained herein. The top wall 51, rear wall 54 and front wall 55 are solid for the purpose of preventing wet mortar and other foreign matter from contaminating the bi-metallic element 40 and its connection with the actuating bar.

A grill 62 covers the front of the ventilator in use to protect the screen 25. The screen 25 is sandwiched between the grill 62 and the front edges of top and bottom walls 21, 22 and side walls 23, 24 of frame 20. Screws as at 63 connect grill 62 to the front of frame 20. The rear screen 26 is retained within inwardly directed channels 64 defined by flanges 65 extending perpendicularly from walls 21, 22, 23, 24 and bent upon themselves as illustrated at 66 in FIG. 6. The flanges 64 also effectively prevent wet mortar from falling on and entering the rear screen 26 during installation of the ventilator in a wall.

In use, the bi-metalic element is set to operate at a desired range of temperatures before the ventilator is installed in a foundation and thereafter changes of temperature beyond the preset range will cause the bi-metallic element to move the extension 35' of actuator bar 35 to open the louvers in warm weather and close the louvers in cold weather without further attention.

The inwardly turned dimpled portion 60 automatically seats against the inner end 41 of bi-metallic element 40 when protective plate 50 is attached as by screws 59 to frame 20, and the inward protuberance 60 reliably and effectively holds inner end 41 in operative relation to stud 43 in use.

The actuator bar 35 raises and lowers in rsponse to the movement of the outer end 42 of the bi-metallic element and imparts corresponding movement to the louvers through their respective flanges with a minimum of parts and a minimum of effort.

There is thus provided an efficient and effective ventilator providing a maximum of air space within a ventilator opening of a predetermined size, and whose operating parts are protected against abuse and contamination by foreign elements such as insects, mortar, dust and dirt, while at the same time exposing the bi-metallic element to the ambient temperature to insure its prompt responsiveness to temperature changes.

Although specific terms have been bemployed in the drawings and specification they are used for descriptive purposes only and not for purposes of limitation.

I claim:

1. In a ventilator having a frame including a pair of opposed walls and a plurality of louvers extending between and pivotally connected to the opposed walls, actuating means pivotally connected to the louvers, a bi-metallic element responsive to changes in temperature to expand in hot weather and contract in cold weather, outwardly opening bifurcated means connecting one end of the bi-metallic element to the frame, means connecting the other end of the bi-metallic element to the actuating means to cause the louvers to open and close in response to movement of the bi-metallic element, the combination of a protective cover connected to the frame and extending about the bi-metallic element and comprising a top wall, a bottom wall, a front wall, a rear wall and a side wall, said cover being dimensioned such that said bi-metallic element remains out of physical contact with said cover during the expansion and contraction of said bi-metallic element, and said front wall and bottom wall each having a plurality of apertures therethrough establishing communication between the bi-metallic element and the ambient temperature and exposing the bi-metallic element to the ambient temperature, the remaining walls of said protective cover protecting the bi-metallic element from contamination by wet mortar, insects and dirt, and a dimpled portion extending inwardly from the said side wall of the said protective cover and registrable with outer open end of said bifurcated means connecting the said one end of the bi-metallic element to said frame to retain the bi-metallic element on the bifurcated means.

2. A ventilator according to claim 1 including a first protective screen extending across the front surface of the frame, a grill in front of the first screen, means connecting the grill to the frame sandwiching the first screen between the grill and the front of the frame, a flange extending perpendicularly from the rear surface of each of said opposed walls, each of said flanges being bent upon itself to define an inwardly opening channel extending around the periphery of the frame, and a second protective screen received in and retained by said inwardly opening channels.

* * * * *